US009256152B2

(12) United States Patent
Jinno et al.

(10) Patent No.: US 9,256,152 B2
(45) Date of Patent: Feb. 9, 2016

(54) IMAGE PROCESSING APPARATUS AND METHOD HAVING VIEWING-DENSITY PRIORITY AND COLOR MATERIAL SAVING MODES

(71) Applicant: CANON KABUSHIKI KAISHA, Tokyo (JP)

(72) Inventors: Takayuki Jinno, Tokyo (JP); Jun Hirabayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 14/050,546

(22) Filed: Oct. 10, 2013

(65) Prior Publication Data

US 2014/0119750 A1 May 1, 2014

(30) Foreign Application Priority Data

Nov. 1, 2012 (JP) ..... 2012-242215

(51) Int. Cl.

| | |
|---|---|
| ***G03G 15/00*** | (2006.01) |
| ***G03G 15/08*** | (2006.01) |
| ***G03G 15/20*** | (2006.01) |
| ***G03G 15/01*** | (2006.01) |

(52) U.S. Cl.

CPC ..... *G03G 15/0173* (2013.01); *G03G 15/2039* (2013.01); *G03G 15/5029* (2013.01); *G03G 2215/209* (2013.01)

(58) Field of Classification Search

CPC ..... G03G 15/01; G03G 15/0173; G03G 15/5029; G03G 2215/209

USPC ..... 399/39, 38, 45, 53, 67

See application file for complete search history.

(56) References Cited

U.S. PATENT DOCUMENTS

| | | | | |
|---|---|---|---|---|
| 5,502,542 | A | 3/1996 | Takano | |
| 2012/0147397 | A1 * | 6/2012 | Kawamoto | 358/1.9 |

FOREIGN PATENT DOCUMENTS

| | | | | |
|---|---|---|---|---|
| JP | 63318572 | A * | 12/1988 | G03G 15/00 |
| JP | 03110576 | A * | 5/1991 | G03G 15/00 |
| JP | 7-199609 | A | 8/1995 | |
| JP | 7-209924 | A | 8/1995 | |
| JP | 07209924 | A * | 8/1995 | G03G 15/00 |
| JP | 2010-118808 | A | 5/2010 | |

* cited by examiner

*Primary Examiner* — Billy Lactaoen

(74) *Attorney, Agent, or Firm* — Fitzpatrick, Cella, Harper & Scinto

(57) ABSTRACT

Transmission information indicating transmittance of light of a printing medium used in image formation is acquired, a reduction ratio with respect to a maximum amount of mounted color materials used in the image formation is set based on the transmission information, and a fixing index indicating a fixing state of the color materials with respect to the printing medium is set based on the transmission information.

11 Claims, 10 Drawing Sheets

FIG. 10A

| TRANSMITTANCE 10% | | | | | |
|---|---|---|---|---|---|
| | | | USE STYLE | | |
| | | | HOLDING | FLAT PLACING | BOOKBINDING |
| PRINTING MODE | VIEWING-DENSITY PRIORITY | TONER REDUCTION RATIO (%) | 100 | 100 | 100 |
| | | FIXING INDEX (%) | 70 | 100 | 80 |
| | TONER SAVING | TONER REDUCTION RATIO (%) | 90 | 90 | 90 |
| | | FIXING INDEX (%) | 80 | 100 | 90 |

FIG. 10B

| TRANSMITTANCE 20% | | | | | |
|---|---|---|---|---|---|
| | | | USE STYLE | | |
| | | | HOLDING | FLAT PLACING | BOOKBINDING |
| PRINTING MODE | VIEWING-DENSITY PRIORITY | TONER REDUCTION RATIO (%) | 100 | 100 | 100 |
| | | FIXING INDEX (%) | 60 | 100 | 80 |
| | TONER SAVING | TONER REDUCTION RATIO (%) | 85 | 85 | 85 |
| | | FIXING INDEX (%) | 70 | 100 | 85 |

IMAGE PROCESSING APPARATUS AND METHOD HAVING VIEWING-DENSITY PRIORITY AND COLOR MATERIAL SAVING MODES

BACKGROUND OF THE INVENTION

1. Field of the Invention

The present invention relates to image processing for improving a viewing density of an image and for reducing the amounts of consumed color materials.

2. Description of the Related Art

As an apparatus for forming an image on a printing medium (to be also referred to as "printing paper" hereinafter), an image forming apparatus for executing image formation based on an electrophotography system (electrophotographic printer) is known. The electrophotographic printer forms an image by transferring toners as color materials onto a printing medium, and fixing the toners on the printing medium by heating and pressing the transferred toners.

In recent years, the use application of the electrophotographic printer is extended from a normal copying machine and printer to POD (Print On Demand) as a light printing range. Accordingly, a toner consumption amount reduction requirement to reduce running cost, and a further image quality enhancement requirement to improve the worth of a printed product itself are increasing.

A wide variety of types of printing media are used for the electrophotographic printer. For example, plain paper (high-quality paper, recycled paper, etc.) is used in an office, and actual printing paper (art paper, coat paper, lightweight coat paper, etc.) is used in POD. Various kinds of such paper which have paper weights as weights per unit area ranging from about 50 g/m$^2$ to 300 g/m$^2$ or more are available, and are set as supported paper in various electrophotographic printers.

In general, as paper has a lower paper weight, it has higher transmittance (transmissivity). Paper having high transmittance causes a phenomenon that when printed paper sheets are stacked, an image printed on an underlying paper is seen through, and when paper is viewed from a backside (reverse) face side, an image printed on a front (obverse) face is seen through (to be referred to as "show-through" hereinafter).

Various techniques have been proposed to suppress occurrence of show-through when double-sided printing is executed using printing paper having high transmittance. As one of these techniques, a corrected image is generated by multiplying, by correction coefficients, an image obtained by mirror-reversing an image to be printed on a backside face of printing paper (to be referred to as "backside image" hereinafter), and pixel values of the corrected image are subtracted from those of an image to be printed on a front face of the printing paper (to be referred to as "front image" hereinafter). Also, in another technique, after one face of printing paper is printed, transmittance of that printing paper is detected, and when the transmittance is high, one of processes for "inhibiting double-sided printing", "changing an image density", and "changing a fixing temperature" is executed. Furthermore, in still another technique, after one face of printing paper is printed, transmittance of the printing paper is detected, and an exposure amount upon printing an image on the other face is controlled.

As a problem caused by the transmittance of printing paper, not only the aforementioned show-through but also a problem of a viewing density change is posed. With this problem, transmitted light intensity difference from the backside face due to transmittance difference influences densities and colors viewed on a printed product.

A general viewing environment of a printed product includes light which is reflected by a wall, desk, or the like and enters the backside face in addition to directly illuminated light on a viewing face of a printed product. This phenomenon will be described below with reference to FIG. 1.

FIG. 1 is a conceptual view of a state in which a printed product is illuminated with light when viewed from a side sectional direction of the printed product. In FIG. 1, the printed product includes printing paper 101 and a toner layer 102 fixed on that paper. A light ray 103 comes from an illumination such as a ceiling illumination or illumination stand and directly enters on a viewing face (front face) of the printed product. A light ray 104 is reflected by a wall, desk, or the like, and enters the backside face of the printed product. As shown in FIG. 1, the light ray 103, which enters the front face of the printed product, is absorbed or scattered by the toner layer 102, or is transmitted through the toner layer 102 and is reflected by the front face of the printing paper 101, and is viewed as a reflected light ray 105 from the printed product.

The light ray 104, which enters the backside face of the printed product, is transmitted through the printing paper 101 and toner layer 102, and is viewed as a transmitted light ray 106. As will be described in detail later, a light ray 107 is scattered by the toner layer 102, and returns to the backside face of the printed product. Light intensity of the transmitted light ray 106 from the backside face to the front face depends on transmittance of the printing paper 101, and increases with increasing transmittance. Light intensity, which is actually viewed by the user as the printed product formed by the toner layer 102, includes that of the reflected light ray 105 and that of the transmitted light ray 106. Therefore, printing paper having higher transmittance has larger light intensity, and a density (viewing density) viewed as the toner layer 102 consequently lowers.

Also, the transmitted light intensity from the backside face to the front face of the printed product varies depending not only on the transmittance of the printing paper but also that of toner fixed on the printing paper. The transmittance of toner varies depending on a fixing state of toner although the mounted amount (applied amount) of that toner (a weight of toner per unit area) remains the same. This is because a void ratio and spatial density of pigment in the toner layer change depending on heat and pressure differences in a fixing process, and degrees of absorption and scattering of light on the toner layer change.

As described above, image quality deterioration caused by the transmittance of printing paper includes the show-through and viewing density change. As a technique for suppressing image quality deterioration, a technique for taking a measure against the show-through like in the aforementioned technique has been proposed. However, a technique for taking a measure against the viewing density change is not available.

Also, as for the toner consumption amount reduction requirement, a technique so-called a toner saving mode, which reduces a toner consumption amount at the sacrifice of a formed image density, is known. However, a technique which reduces a toner consumption amount while maintaining a viewing density of an image is not available.

SUMMARY OF THE INVENTION

In one aspect, an image processing apparatus comprises an acquisition unit configured to acquire transmission information indicating transmittance of light of a printing medium used in image formation; a first setting unit configured to set a reduction ratio with respect to a maximum amount of mounted color materials used in the image formation based on the transmission information; and a second setting unit configured to set a fixing index indicating a fixing state of the color materials with respect to the printing medium based on the transmission information.

According to the aspect, a viewing density of an image can be enhanced, and a consumption amount of color materials can be reduced.

Further features of the present invention will become apparent from the following description of exemplary embodiments with reference to the attached drawings.

BRIEF DESCRIPTION OF THE DRAWINGS

FIGS. 10A and 10B are tables showing a correspondence example between the transmittance of printing paper, and a toner reduction ratio and fixing index.

DESCRIPTION OF THE EMBODIMENTS

Image processing according to embodiments of the present invention will be described in detail hereinafter with reference to the drawings. Note that the following embodiments do not limit the present invention related to the scope of the claims, and all of combinations of characteristic features described in the embodiments are not indispensable for solution of the present invention.

First Embodiment

[Color Developing Mechanism in Consideration of Transmitted Light ]

Prior to the description of image processing of this embodiment, color developing in consideration of transmitted light will be described below with reference to FIGS. 2 to 4 and FIG. 15.

Figure 2:
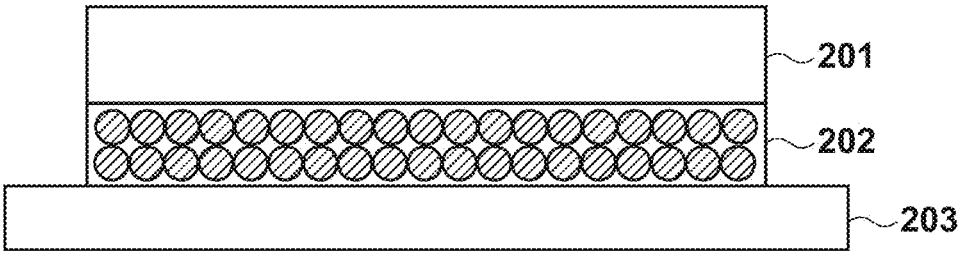
FIG. 2 is a sectional view of a printed product having a toner incomplete fixing layer.

FIG. 2 is sectional view of a printed product having an incomplete fixing layer in which toner is not completely fixed. In general, in an electrophotographic printer, toner transferred onto printing paper has a different degree of melting depending on degrees of heat and pressure in a fixing process. FIG. 2 shows toner layers 201 and 202 fixed on printing paper 203 under a certain fixing condition.

The toner layer 201 is a complete fixing layer in which toner particles are completely melted and fixed. The toner layer 202 is an incomplete fixing layer in which toner particles are not completely melted in a fixing process, and toner particles themselves and voids between toner particles are left. Since the toner layer 202 has a lower toner density than the toner layer 201 as the complete fixing layer, light to be absorbed per unit length is decreased. Since many voids and non-melted toner particles exist, light to be scattered per unit length is increased.

Figure 1:
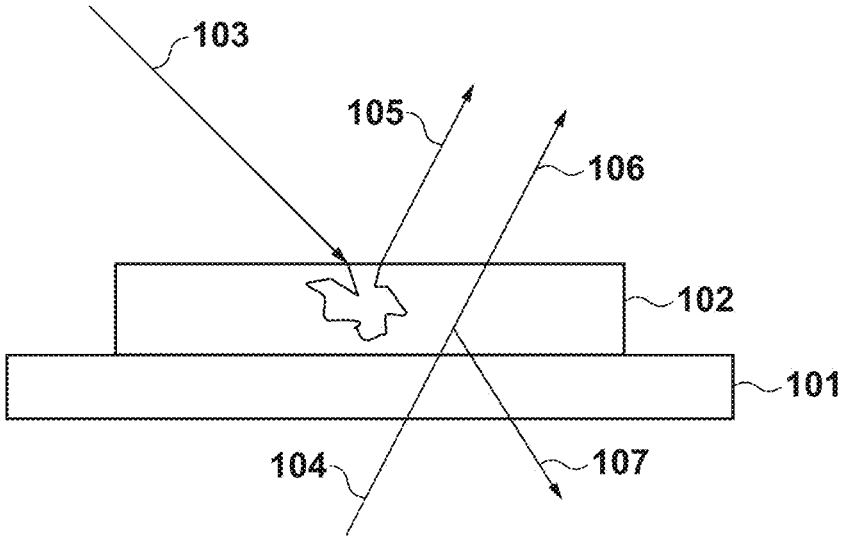
FIG. 1 is a conceptual view showing a state in which a printed product is illuminated with light when viewed from a side sectional direction of the printed product.

Such increase in scattering increases light intensity of scattered light corresponding to a light ray 107 shown in FIG. 1 in the toner layer 202. As described above, the light ray 107 shown in FIG. 1 is that which returns to the backside face due to scattering of a toner layer 102. When the light intensity of the light ray 107 is increased, that of a transmitted light ray 106 which is transmitted through the toner layer 102 is decreased. On the other hand, in the toner layer 202 as the incomplete fixing layer, light intensity to be absorbed per unit length is decreased. However, it is considered that since a decrease in thickness of the toner layer 202 due to heating and pressing is smaller than in the complete fixing layer, transmitted light intensity is consequently the same as that of the complete fixing layer.

That is, in the toner layer 202 as the incomplete fixing layer, although light absorption does not change depending on a fixing state, since light intensity which returns to the backside face due to scattering of light is increased, the transmitted light intensity is decreased. Also, light intensity of a reflected light ray 105 changes due to a change in absorption and scattering per unit thickness. That is, as a degree of absorption is smaller or that of scattering is larger, light intensity of light which returns to a viewing face (front face of a printed product) is increased.

A rate of a thickness of a complete fixing layer to that of an entire toner layer including complete and incomplete fixing layers will be referred to as "fixing rate" hereinafter. The light intensities of the reflected light ray 105 and transmitted light ray 106 change according to the fixing rate, and a density of an image to be viewed (viewing density) also changes according to this light intensity change.

Also, the light intensity of the transmitted light ray 106 changes by not only the fixing rate, but also the transmittance of printing paper, and is increased with increasing transmittance of the printing paper.

Figure 3:
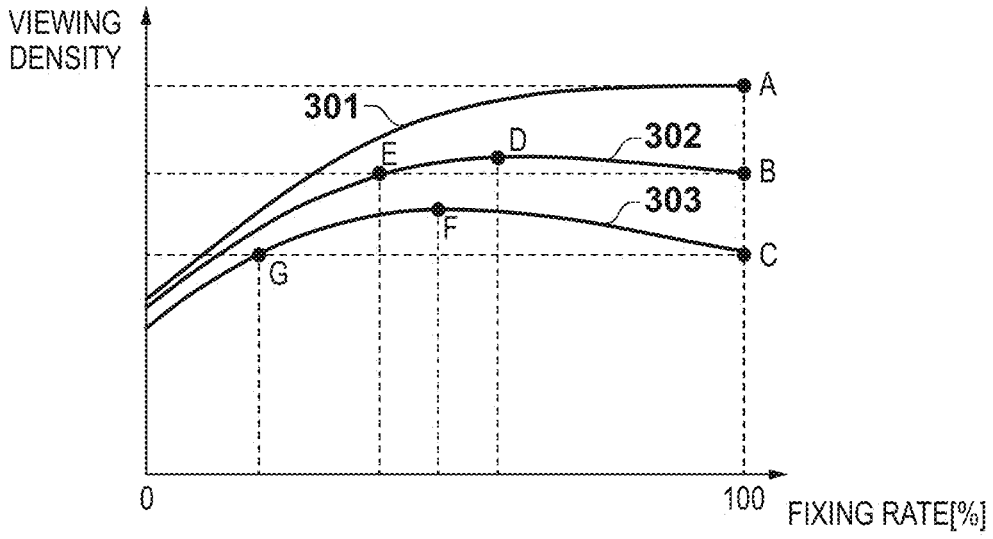
FIG. 3 is a graph showing the relationship between the fixing rate and viewing density.

FIG. 3 shows the relationship between the fixing rate and viewing density. In FIG. 3, a curve 301 expresses the relationship between the fixing rate and viewing density when no light enters the backside face of a printed product. Likewise, curves 302 and 303 express the relationships between the fixing rate and viewing density when light of the same light intensity enters the backside face of a printed product. A difference between the curves 302 and 303 is that between transmittance of printing paper sheets. In this case, the transmittance of the printing paper corresponding to the curve 303 is higher than that of the printing paper corresponding to the curve 302.

In the example of the curve 301, the viewing density is highest at a point A where a toner layer fully becomes a complete fixing layer. This is simply because scattering of light is increased if an incomplete fixing layer is included, and light intensity of the reflected light ray 105 is consequently increased, thus lowering the viewing density.

On the other hand, the example of the curve 302 indicates that the viewing density is higher when an incomplete fixing layer is included at a predetermined rate or less compared to a point B where a toner layer fully becomes a complete fixing layer. That is, the viewing density at a fixing rate or more of a point E is not less than that at the point B, and is maximized at a point D. This is because light intensity of the reflected light ray 105 is increased due to scattering of light if an incomplete fixing layer is included, while light intensity of the transmitted light ray 106 is decreased due to an increase in light intensity of the light ray 107 which returns to the backside face.

Likewise, in the example of the curve 303, a viewing density at a fixing rate or more of a point G is not less than that at a point C, and is maximized at a point F. By comparing these curves 302 and 303 at the same fixing rate, the curve 302 has a higher density. This is because the transmittance of the printing paper corresponding to the curve 302 is higher, and light intensity of the transmitted light ray 106 is smaller. Also, as can be seen from comparisons of density differences between the points B and D and between the points C and F, a density change based on the fixing rate of the curve 303 corresponding to the higher transmittance of the printing paper is larger.

Figure 15:
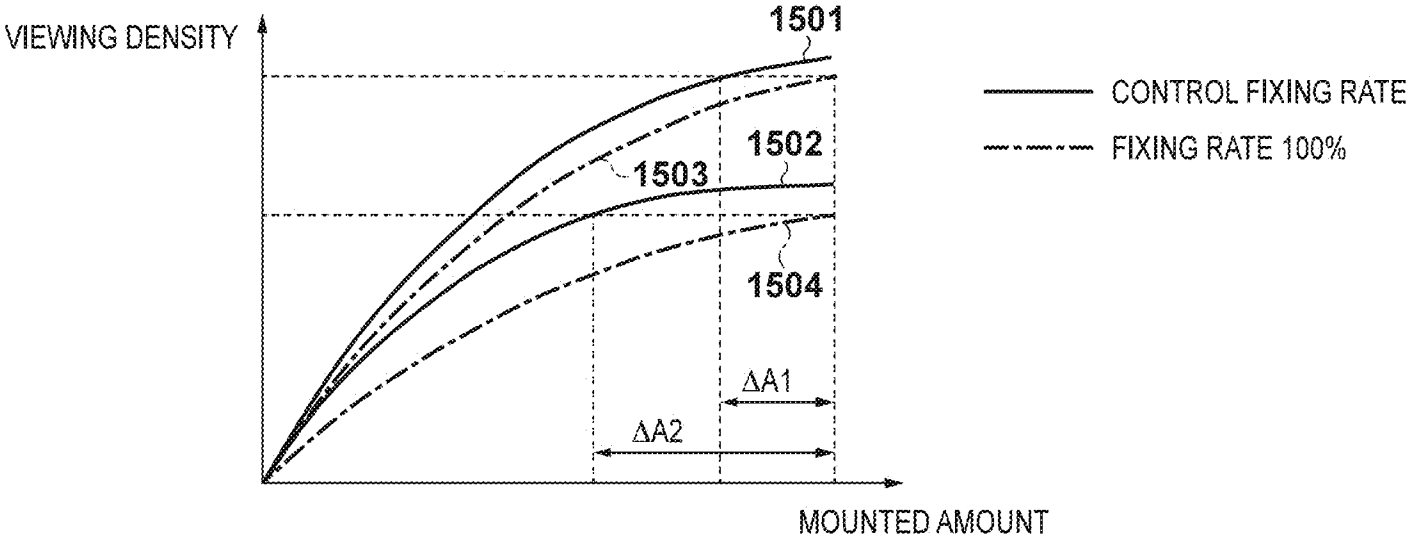
FIG. 15 is a graph showing the relationship between a mounted amount and viewing density when light enters a backside face of a printed product.

FIG. 15 shows the relationship between the mounted amount and viewing density when light enters the backside face of a printed product. In FIG. 15, curves 1501 and 1502 express changes in viewing density with respect to the mounted amount of toner when the fixing rate is appropriately controlled to maximize the viewing density. Also, curves 1503 and 1504 express changes in viewing density with respect to the mounted amount of toner when the fixing rate is 100%. Note that the curves 1501 and 1503 correspond to printing paper having low transmittance, and correspond to the curve 302 in FIG. 3. Also, the curves 1502 and 1504 correspond to printing paper having high transmittance, and correspond to the curve 303 in FIG. 3.

In FIG. 15, as can be seen from examination of differences between mounted amounts which attain the maximum viewing density at the fixing rate=100% and that between mounted amounts required to obtain the viewing density equivalent to the maximum viewing density at the fixing rate=100% by controlling the fixing rate, a difference $\Delta A2$ between the curves 1502 and 1504 corresponding to the printing paper having the high transmittance is larger than a difference $\Delta A1$ between the curves 1501 and 1503 corresponding to the printing paper having the low transmittance. That is, when the maximum viewing density corresponding to the fixing rate=100% is attained by appropriately controlling the fixing rate, a toner amount that can be saved is larger as the transmittance of printing paper is higher.

Figure 4:
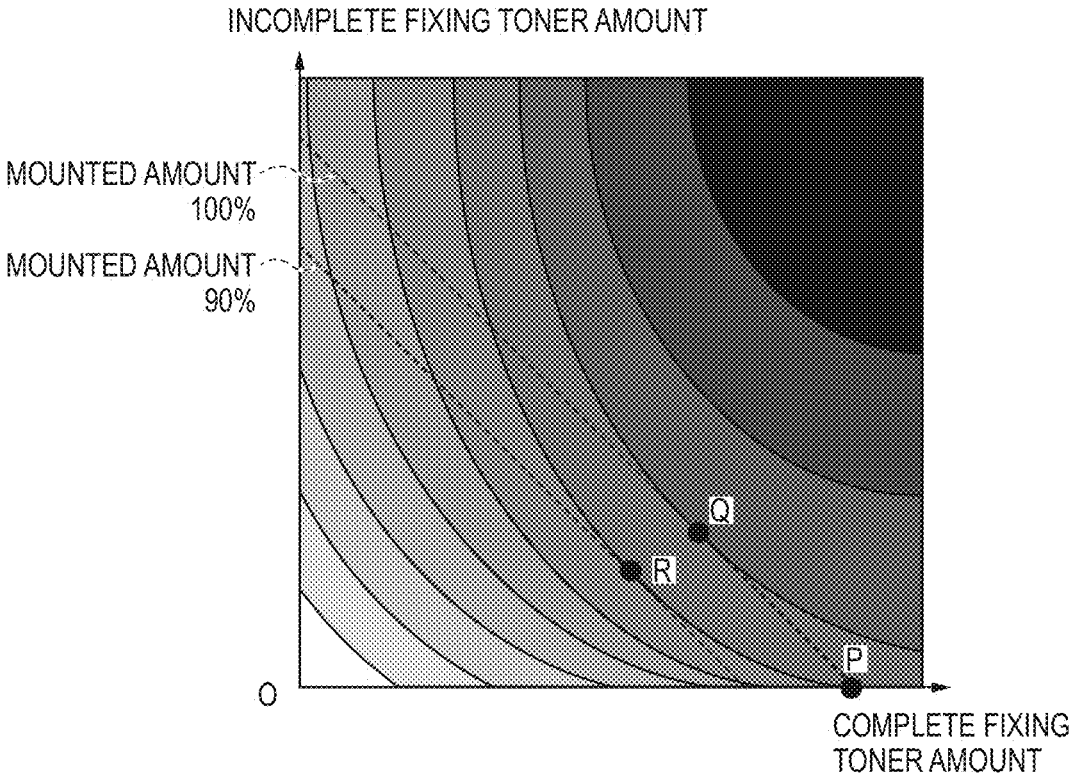
FIG. 4 is a graph showing a density change in an image formed with a complete fixing layer and incomplete fixing layer.

FIG. 4 is a graph showing a change in viewing density in an image formed with complete and incomplete fixing layers. Lines indicated by broken lines in FIG. 4 are equivalent mounted amount lines indicating constant mounted amounts. In FIG. 4, as a color is darker, a viewing density of an image is higher. Note that the curves shown in FIG. 3 indicate viewing density changes on the equivalent mounted amount lines in FIG. 4.

In FIG. 4, a point P indicates a case in which a mounted amount is 100%, and a toner layer is fully complete layer, a point Q indicates a case in which a mounted amount is 100%, and an incomplete fixing layer is formed under a complete fixing layer, and a point R indicates a case in which a mounted amount is 90%, and an incomplete fixing layer is formed under a complete fixing layer. As can be seen from FIG. 4, even when the mounted amount remains the same, the viewing density at the point Q including the incomplete fixing layer is higher than that at the point P including the full complete fixing layer. Thus, by appropriately controlling the fixing rate, a higher viewing density can be attained. Also, as can be seen from FIG. 4, the viewing density at the point P where the mounted amount is 100% and the full complete fixing layer is formed is equal to that at the point R where the mounted amount is 90% and the incomplete fixing layer is included. That is, by appropriately controlling the fixing rate, printed products having the same viewing density can be obtained even when reducing a toner amount.

[Arrangement of Image Forming Apparatus]

The arrangement of an image processing apparatus according to this embodiment will be described below.

Image Processing Apparatus

Figure 5:
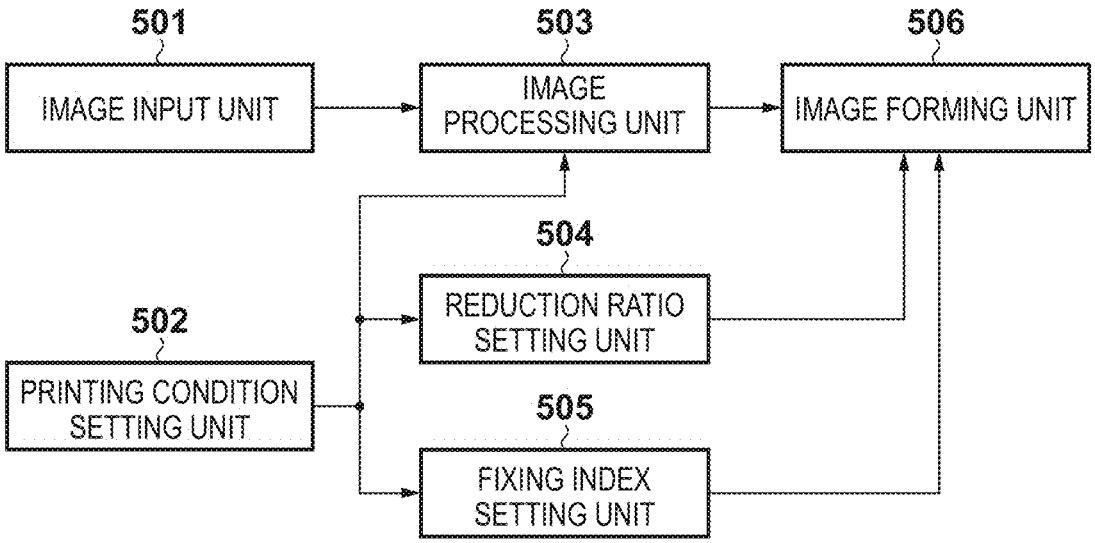
FIG. 5 is a block diagram showing the arrangement of an image processing apparatus according to the first embodiment.

FIG. 5 is a block diagram showing the arrangement of the image processing apparatus of this embodiment. An image input unit 501 inputs image data to be printed. A printing condition setting unit 502 inputs a user instruction of a printing condition. The printing condition includes a size of output printing paper, double-sided printing setting, page layout, color mode, a type of the output printing paper (to be referred to as "paper type" hereinafter), printing intent, printing quality, printing mode, use style of a printed product, and the like. Note that the size of the output printing paper, double-sided printing setting, page layout, and color mode are the same as those in a condition set in a general printer, and a description thereof will not be given.

As the paper type, types of printing paper such as coat paper and plain paper, and a paper weight of printing paper can be selected. As the printing intent, types of image data to be printed such as general, DTP (Desk Top Publishing), graphics, photo, CAD (Computer Aided Design), and high-resolution document can be selected. As the printing quality, a resolution, the number of tones, a type of halftone processing, and the like can be selected.

Figure 7:
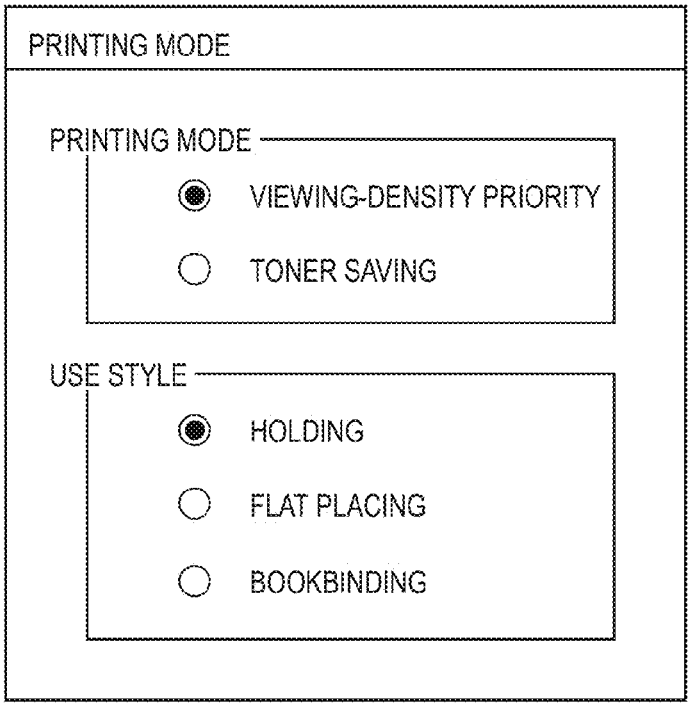
FIG. 7 is a view showing an example of a user interface which allows the user to select a printing mode and use style.

The printing mode and use style will be described below with reference to FIG. 7. FIG. 7 shows an example of a user interface which allows the user to select the printing mode and use style. The user can select one of "viewing-density priority" which enhances a viewing density and "toner saving (color material saving)" which saves a use amount of toner. As the use style of a printed product, the user can select one of "holding", "flat placing", and "bookbinding".

The use style is deeply related to the viewing condition of a printed product. That is, in this embodiment, information of these use styles is used as backside light intensity information indicating a degree of light intensity which may come from the backside face of a viewing face in association with a printed product. In case of "holding", that is, when the user views a printed product while holding it in his or her hand, light intensity which enters the backside face of the printed product is assumed to be large. In case of "flat placing", that is, when the user views a printed product while placing it on, for example, a desk, light intensity which comes from the backside face of the printed product is assumed to be small except for a case in which the printed product is placed on a desk of a light color or is affixed on a wall of a light color. On the other hand, in case of "bookbinding", white printing paper is assumed to exist on the back side of a printed product except for a case in which a high-density object is printed on the backside face of a page of the printed product to be viewed or on the next page. Therefore, in case of "bookbinding", since reflected light from printing paper comes from the backside face of a printed product, light intensity coming from the backside face falls between "holding" and "flat placing". Note that the use styles are not limited to the examples shown in FIG. 7, and other items corresponding to possible viewing conditions (for example, "poster" which assumes that a printed product is affixed on a wall) may be added.

Note that the printing condition setting unit 502 may be installed in a printer driver which runs on a computer (PC) or may be installed in a printer main body to allow the user to select the use style using a touch panel or the like of a printer. Alternatively, the printing condition setting unit 502 may be installed in both the PC and printer without posing any problem. Also, especially, as for the paper type setting, a paper type determination sensor may be arranged in the apparatus. In this case, information associated with transmittance of printing paper, which is measured by the paper type determination sensor, can be acquired without prompting the user to select a paper type.

An image processing unit 503 applies various image processes to image data input from the image input unit 501, and outputs the image data which has undergone the image processes to an image forming unit 506. Details of the image processes will be described later.

A reduction ratio setting unit 504 sets a toner reduction ratio (to be described later) based on the printing condition set by the printing condition setting unit 502, and outputs the toner reduction ratio to the image forming unit 506. A fixing index setting unit 505 sets a fixing index (to be described later) based on the printing condition, and outputs the fixing index to the image forming unit 506. The image forming unit 506 forms a visible image on printing paper based on the toner reduction ratio and fixing index.

Image Forming Unit

Figure 6:
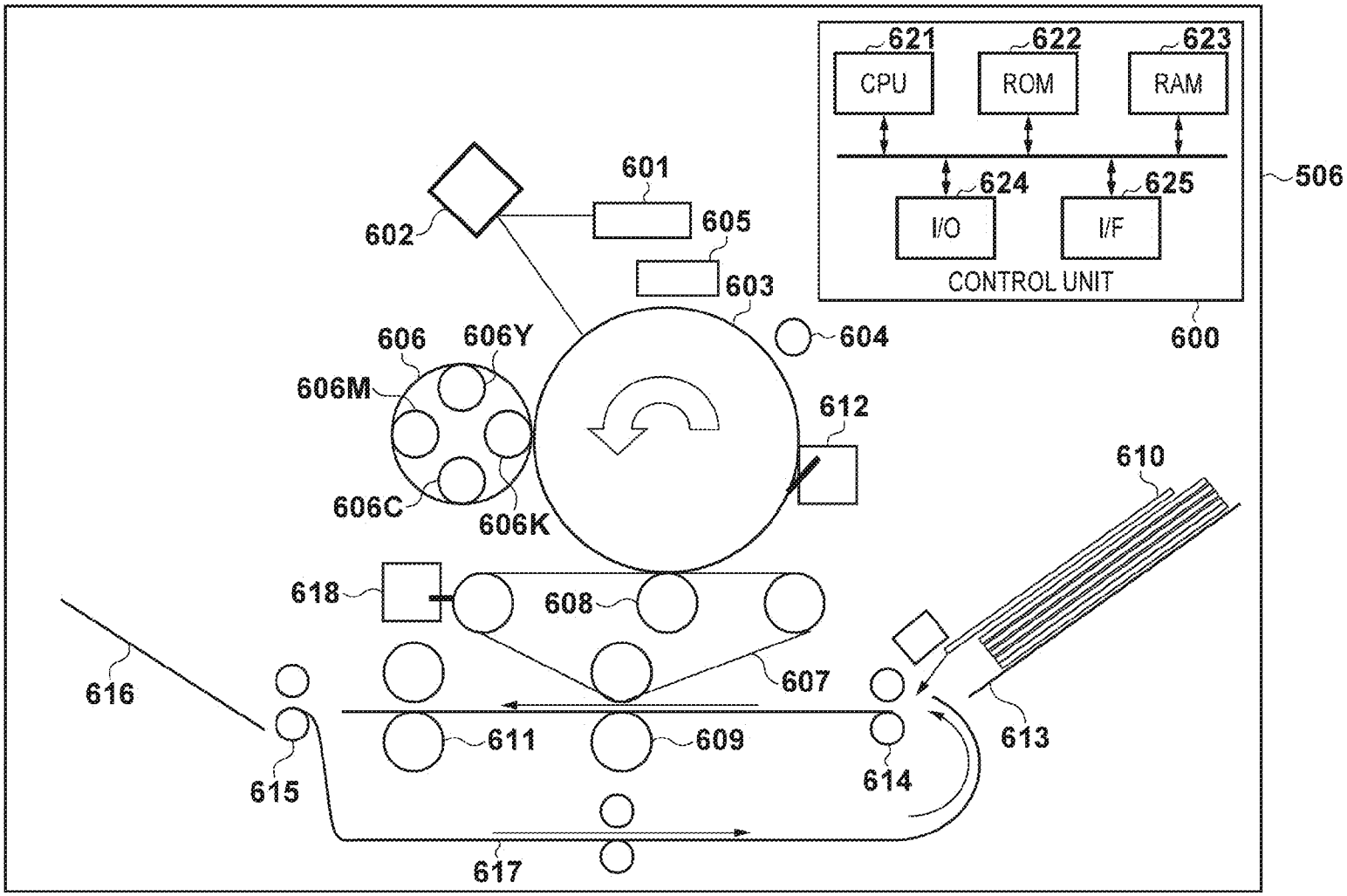
FIG. 6 is a sectional view showing the arrangement of an image forming unit.

The arrangement of the image forming unit 506 will be described below. Assume that the image forming unit 506 executes image formation on a printing medium by a 1-drum type electrophotography process, and FIG. 6 is a sectional view of the image forming unit 506. That is, FIG. 6 shows the arrangement of the image forming unit 506 shown in FIG. 5, and the remaining units 501 to 505 in FIG. 5 are arranged in a control unit 600 shown in FIG. 6 or in an image processing apparatus as a computer connected to the control unit 600.

In FIG. 6, a CPU (microcontroller) 621 of the control unit 600 executes a program stored in a ROM (Read Only Memory) 622 using a RAM (Random Access Memory) 623 as a work memory, and controls the operations of respective components of the image forming unit 506 through an I/O (input/output port) 624, thereby executing an image formation process of image data input through an I/F (communication interface) 625. When the units 501 to 505 in FIG. 5 are arranged in the external image processing apparatus, the control unit 600 receives information indicating the toner reduction ratio and fixing index, and a print job including image data to be printed from the image processing apparatus through the I/F 625.

A photosensitive drum 603 as a photosensitive body is uniformly discharged by a discharger 604, and is then uniformly charged by a charger 605. A laser diode 601 emits a laser beam corresponding to binary image data generated by a quantization unit 805 (to be described later). The laser beam exposes and scans the surface of the photosensitive drum 603 as an image carrier, which is rotating in a direction of an arrow shown in FIG. 6, via a polygon mirror 602 and fθ lens (not shown). As a result, an electrostatic latent image according to the binary image data is formed on the surface of the photosensitive drum 603.

The electrostatic latent image is developed as a toner image by toner supplied from a developer 606. The toner image is transferred onto an intermediate transfer belt 607, which is extended between a plurality of rollers and is endlessly driven, upon operation of a primary transfer unit 608.

The aforementioned series of operations, that is, charging, exposure, development, and transfer operations are repeated while switching developing units of respective colors (cyan 606C, magenta 606M, yellow 606Y, and black 606K) used in the developer 606. In this manner, toner images of a plurality of colors, which are sequentially transferred onto the intermediate transfer belt 607, are formed.

On the other hand, a printing medium 610 is conveyed from a paper feed tray 613 to registration rollers 614, and is then conveyed to a secondary transfer unit 609 at an appropriate timing by the registration rollers 614. Then, the toner images of the plurality of colors transferred onto the intermediate transfer belt 607, are transferred onto the conveyed printing medium 610 by the secondary transfer unit 609. The printing medium 610, on which the toner images are transferred, passes through a fixing unit 611, and the toner images are fixed on the printing medium 610.

After that, when a double-sided printing mode is not selected, the printing medium 610 is discharged onto a discharge tray 616 by discharge rollers 615. On the other hand, when the double-sided printing mode is selected, the printing medium 610 is guided onto a convey path 617 upon reverse rotation of the discharge rollers 615 when its trailing end reaches the discharge rollers 615, and is conveyed to the registration rollers 614. Then, the printing medium 610 is conveyed again to the secondary transfer unit 609 at an appropriate timing by the registration rollers 614, and toner images are transferred and fixed on a second face of the printing medium 610. Then, the printing medium 610 is discharged onto the discharge tray 616.

Residual toner which remains on the photosensitive drum 603 is scraped and recovered by a photosensitive drum cleaner 612. After the printing medium 610 is separated, residual toner on the intermediate transfer belt 607 is scraped by an intermediate transfer belt cleaner 618 such as a blade.

Note that this embodiment has exemplified the image forming unit 506 which adopts the 1-drum type electrophotography system. However, the image forming unit 506 is not limited to such specific example, and may also be implemented by a tandem type electrophotography system having respective mechanisms for corresponding developers of a plurality of colors, or other printing systems.

Image Processing Unit

Figure 8:
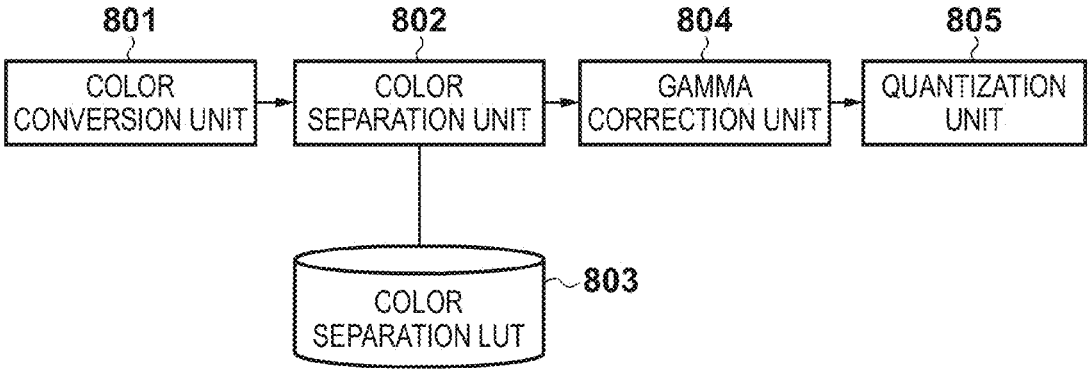
FIG. 8 is a block diagram showing the arrangement of an image processing unit.

The image processes in the image processing unit 503 will be described below with reference to FIG. 8. FIG. 8 is a block diagram showing the arrangement of the image processing unit 503. The image processing unit 503 executes the following image processes in accordance with image data input from the image input unit 501 and the printing condition set by the printing condition setting unit 502.

A color conversion unit 801 maps signal values (RGB values, CMYK values, etc.) of the input image data onto a device-independent color space (a color space such as CIELab or CIEXYZ). In general, since the color reproduction range of the printer is narrower than that of the monitor, the color conversion unit 801 maps colors of the input image data to those within a reproducible range of the printer. This mapping is executed based on, for example, a lookup table (LUT) which describes the correspondence relationship between RGB values and L*a*b* values. Alternatively, matrix calculations may be made.

A color separation unit 802 color-separates values on the device-independent color space represented by the image data after mapping into signal values (CMYK values, etc.) corresponding to respective color materials included in the image forming unit 506. A conversion method in this color separation is not particularly limited. For example, conversion is executed with reference to a color separation LUT 803 which describes the correspondence relationship between L*a*b* values and CMYK values.

A gamma correction unit 804 applies lightness correction processing, which is required to obtain satisfactory tones of an image printed on printing paper, to the image data after color separation. As lightness information to be corrected in this unit, for example, luminance information, lightness information, density information, or the like is used. Also, the gamma correction unit 804 controls the image data according to the paper type indicated by the printing condition so that a total of the mounted amount of color materials does not exceed a maximum amount of mounted toner. Note that the maximum amount of mounted toner corresponds to an upper limit of a mounted amount which can prevent toner transferred onto printing paper or intermediate transfer belt from being scattered in the electrophotography process.

A quantization unit 805 quantizes each of the image data using halftone processing (e.g., an error diffusion method and green noise method) set up as the printing condition, which correspond to the respective color materials and have undergone the lightness correction in the gamma correction unit 804, to the number of bits which can be processed by the image forming unit 506. Then, the quantization unit 805 outputs the quantized 1-bit image data per color to the image forming unit 506.

Condition Setting Unit

Figure 9:
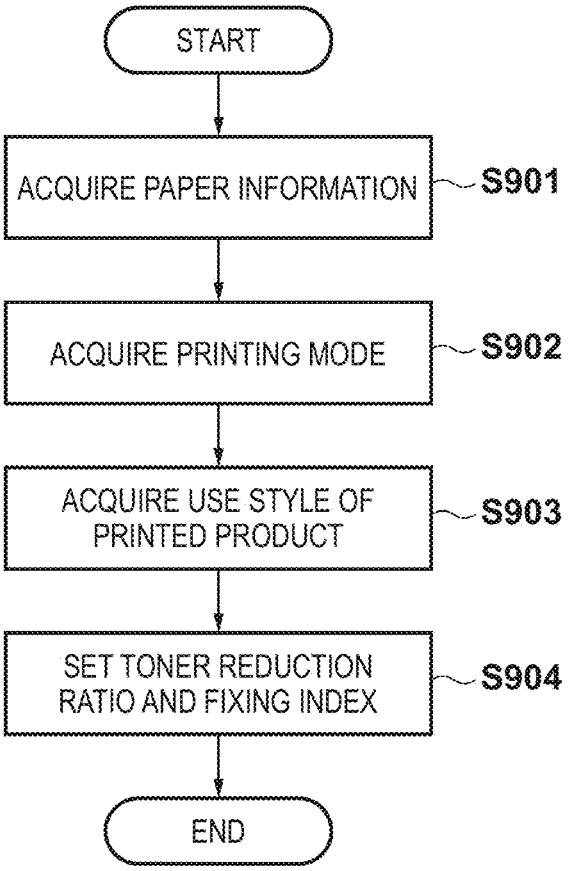
FIG. 9 is a flowchart showing setting processing of a toner reduction ratio and fixing index.

The reduction ratio setting processing of the reduction ratio setting unit 504 and the fixing index setting processing of the fixing index setting unit 505 will be described below with reference to the flowchart shown in FIG. 9.

The reduction ratio setting unit 504 sets a toner reduction ratio required to control an exposure condition. The toner reduction ratio indicates maximum percentages of a mounted amount of toner with respect to the maximum amount of mounted toner.

The fixing index setting unit 505 sets a fixing index required to control a fixing condition. A degree of melting and fixing of toner particles changes depending on a pressure, temperature, and time when the printing medium 610 on which toner images have been transferred passes through the fixing unit 611. That is, the fixing index indicates percentages of the degree of melting and fixing to have, as 100%, a state of the highest degree of melting and fixing within a range that does not cause any trouble, and totally indicates degrees of heating, pressing, and speed of the fixing unit 611.

The aforementioned "fixing rate" of toner is controlled by the magnitudes of the toner reduction ratio and fixing index. A combination of the reduction ratio setting unit 504 and fixing index setting unit 505 will be referred to as "condition setting unit" hereinafter.

The condition setting unit acquires paper information (S901). The paper information can be information indicating light transmission of printing paper, and may be, for example, information of transmittance, paper weight, thickness, and the like. More specifically, transmission information is acquired in step S901.

Next, the condition setting unit acquires printing mode information (S902). The printing mode information is information indicating "viewing-density priority" or "toner saving", as described above.

Next, the condition setting unit acquires use style information of a printed product (S903). The use style is that of a printed product, as described above, that is, it is information indicating backside light intensity information coming from the backside of the printed product by one of "holding", "flat placing", and "bookbinding". That is, the backside light intensity information is acquired in step S903.

Then, the condition setting unit sets the toner reduction ratio and fixing index based on the respective pieces of information acquired in steps S901, S902, and S903 (S904).

Toner Reduction Ratio and Fixing Index

FIGS. 10A and 10B show correspondence examples between the transmittance of printing paper, and the toner reduction ratio and fixing index. FIGS. 10A and 10B show only toner reduction ratios and fixing indices corresponding to two different transmittance for the sake of simplicity, but toner reduction ratios and fixing indices for higher transmittance (for example, 30%) of printing paper are desirably prepared. When toner reduction ratios and fixing indices corresponding to, for example, a transmittance=13% of printing paper are not available, those for the closest transmittance may be used, or they may be calculated by interpolation calculations based on the toner reduction ratios and fixing indices for the transmittance=10% and 20%. On the other hand, when the paper information acquired in step S901 does not directly indicate transmittance, toner reduction ratios and fixing indices corresponding to transmittance may be specified with reference to, for example, a table which describes the correspondence relationship between values (paper weight, thickness, etc.) acquired as the paper information and transmittance.

According to FIGS. 10A and 10B, a smaller toner reduction ratio is set for a certain transmittance irrespective of the use style when the printing mode is "toner saving" compared to a case in which it is "viewing-density priority". Also, a fixing index is set to be larger in turn for the use styles in an order of "holding", "bookbinding", and "flat placing". This is because light intensity coming from the backside face of a printed product to be viewed is assumed to be increased in an order of "holding", "bookbinding", and "flat placing".

The reason why lower fixing indices are set for "holding" and "bookbinding" is that when incident light intensity from the backside face is large, the viewing density is highest when the fixing rate is lower than 100%, as has been described using FIG. 3. Hence, in case of "holding" and "bookbinding", that is, when incident light comes from the backside face, a fixing index, which sets a lower degree of melting of toner as transmittance of printing paper is higher, that is, which sets a higher void ratio between particles without completely melting toner, in other words, a lower fixing rate, is set.

When the transmittance of printing paper is high, a change between a toner reduction ratio of "viewing-density priority" and that of "toner saving" is set to be large. In other words, a large toner reduction amount is set. This is because a maximum viewing density corresponding to the fixing rate=100% can be attained by appropriately controlling the fixing rate even when the mounted amount of toner is reduced as the transmittance of the printing paper is higher, as described above.

Figure 11:
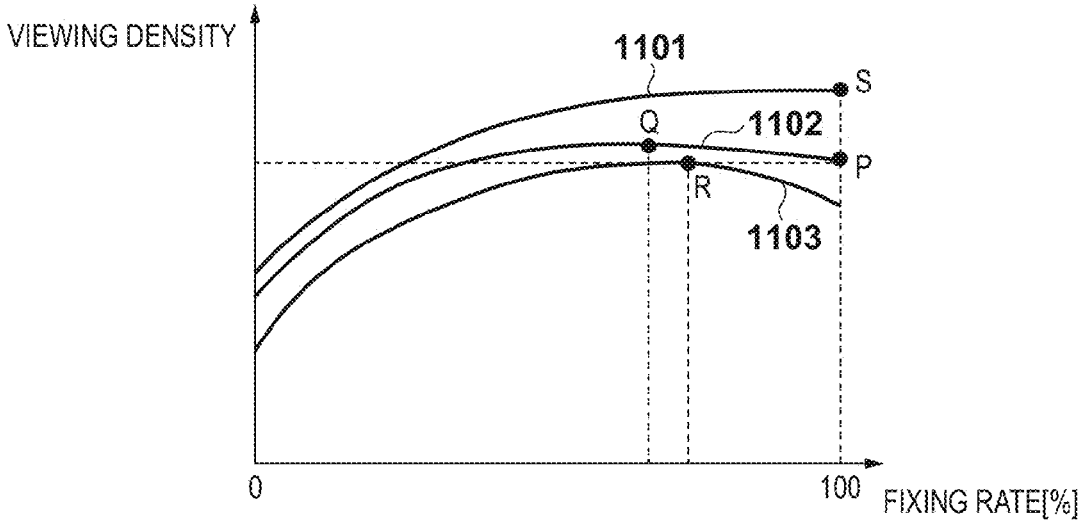
FIG. 11 is a graph showing the relationship between a fixing rate and viewing density according to a mounted amount of toner.

FIG. 11 is a graph showing the relationship between the fixing rate and viewing density when mounted amounts of toner are different on single printing paper. Curves 1102 and 1103 in FIG. 11 correspond to the equivalent mounted amount lines shown in FIG. 4, and a curve 1101 when reflected light from the backside face can be ignored is further added. That is, the curve 1101 expresses the relationship between the fixing rate and viewing density in case of the mounted amount=100% and "flat placing". The curve 1102 expresses the relationship between the fixing rate and viewing density in case of the mounted amount=100% and "holding". The curve 1103 expresses the relationship between the fixing rate and viewing density in case of the mounted amount=90% and "holding". That is, as also described above using FIG. 4, the point P indicates a case in which the mounted amount is 100% and the fixing rate is 100%, the point Q indicates a case in which the mounted amount is 100% and the fixing rate is 70%, and the point R indicates a case in which the mounted amount is 90% and the fixing rate is 80%.

According to FIG. 11, the viewing density at the point Q is higher than that at the point P, and the viewing densities at the points R and P are nearly equal to each other. Note that in the case of "flat placing" expressed by the curve 1101, the viewing density is higher with increasing fixing rate. Note that FIG. 11 does not show an example of "bookbinding", but it is expressed by an intermediate curve between "flat placing" and "holding". In this embodiment, a table required to determine the toner reduction ratio and fixing index according to the transmittance of printing paper, printing mode, and use style is generated based on such relationship among the mounted amount of toner, fixing rate, and viewing density, as shown in FIGS. 10A and 10B.

Exposure Control

The control unit 600 of the image forming unit 506 executes exposure control for controlling the exposure condition (a pulse width or pulse amplitude of a pulse signal to be supplied to the laser diode 601) so as to attain exposure according to the toner reduction ratio. The exposure control in the control unit 600 will be described below with reference to FIGS. 12A to 12C.

Figure 12A:
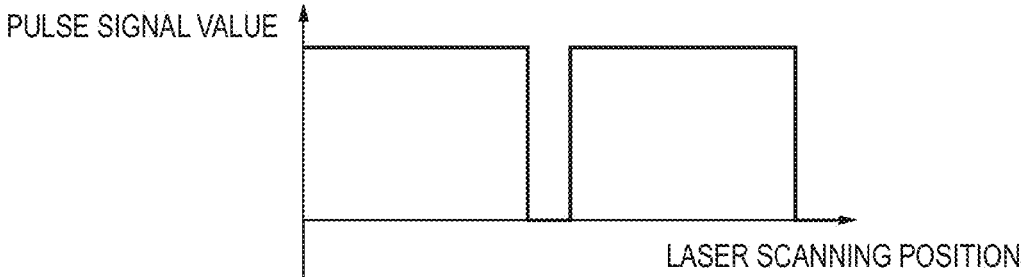
FIGS. 12A to 12C are explanatory charts of exposure control.
Figure 12B:
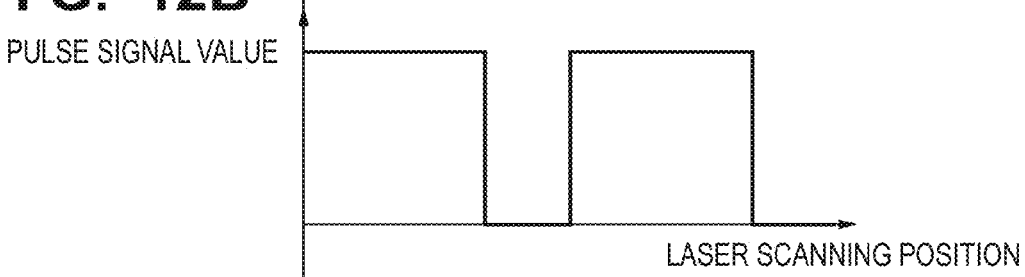
Figure 12C:
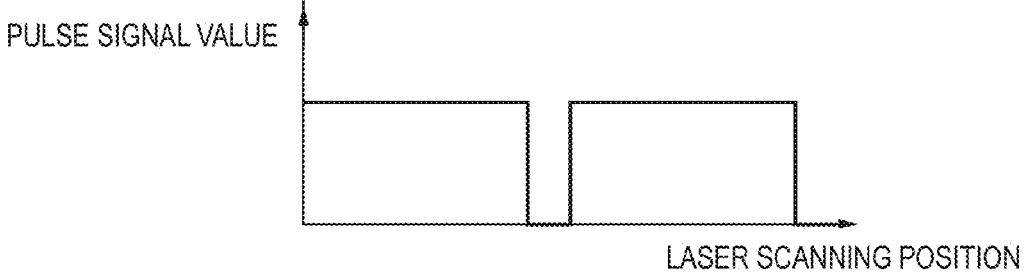

FIGS. 12A to 12C are explanatory charts of the exposure control, and show the correspondence between a pulse signal used to control the laser diode 601 to emit a laser beam and the scanning positions on the photosensitive drum 603. For example, in case of a black solid region of K=100%, the pulse signal is supplied, as shown in FIG. 12A.

FIG. 12B shows a pulse signal example when a total amount of light with which the photosensitive drum 603 is irradiated is reduced by applying pulse-width modulation to the pulse signal shown in FIG. 12A. The pulse signal shown in FIG. 12B has a narrower ON width than that of the pulse signal shown in FIG. 12A, and the light intensity with which the photosensitive drum 603 is irradiated is consequently reduced.

FIG. 12C shows a pulse signal example when a total amount of light with which the photosensitive drum 603 is irradiated is reduced by applying pulse-width modulation to the pulse signal shown in FIG. 12A. The pulse signal shown in FIG. 12C has the same ON width as that of the pulse signal shown in FIG. 12A, but has a smaller signal value. As a result, a light emitting amount of the laser diode 601 is decreased, and the light intensity with which the photosensitive drum 603 is irradiated is reduced.

In other words, FIG. 12A corresponds to a pulse signal for a solid region when the toner reduction ratio is 100% (without reducing the amount of mounted toner), and FIG. 12B or 12C corresponds to a pulse signal for a solid region when the toner reduction ratio is, for example, 80%.

In this manner, even when an image signal after quantization as an image formation target of the image forming unit 506 remains the same, the exposure control is executed in the image formation process, thus changing the exposure amount on the photosensitive drum 603, changing a latent image potential on the photosensitive drum 603 accordingly, and changing a toner amount to be developed consequently. That is, the control unit 600 can control the mounted amount of toner to be transferred onto printing paper according to the toner reduction ratio.

That is, when the control unit 600 holds, in advance, a table which indicates the relationship between the pulse width or pulse amplitude of a pulse signal to be supplied to the laser diode 601, and one of the latent image potential, developing amount, and mounted amount of toner, the pulse width or pulse amplitude can be appropriately controlled in accordance with the toner reduction ratio. With this control, the control unit 600 can appropriately control the amount of mounted toner in correspondence with a target value (toner reduction ratio). That is, as the toner reduction ratio is larger, the mounted amount of toner is increased. Conversely, as the toner reduction ratio is smaller, the mounted amount of toner can be decreased.

Fixing Control

The control unit 600 executes fixing control required to control a pressure, temperature, and time when the printing medium 610 on which toner images have been transferred passes through the fixing unit 611, so as to attain fixing according to the fixing index.

In the fixing unit 611, within a range in which no trouble called hot offset, that is, unwanted transfer of some toner particles to a fixing roller occurs, as a fixing pressure is higher, as a fixing temperature is higher, and as a fixing time is longer (that is, a fixing rate is lower), a degree of melting and fixing of toner particles is higher. Note that even when the degree of melting and fixing of toner remains the same, a fixing rate varies depending on the type and mounted amount of toner. That is, the control unit 600 holds, in advance, the relationship between the fixing condition (fixing pressure, fixing temperature, and fixing time) and the fixing index for each toner type and each mounted amount of toner, thus controlling the fixing condition according to the fixing index. Thus, the control unit 600 can appropriately control the degree of melting and fixing of toner particles in correspondence with a target value (fixing index). That is, the control unit 600 completely fixes the toner layer by increasing the degree of melting and fixing of toner particles as the fixing index is larger. Conversely, the control unit 600 leaves an incomplete fixing layer of toner by weakening the degree of melting and fixing of toner particles as the fixing index is smaller. For example, when the fixing index assumes a maximum value=100%, the control unit 600 controls the fixing condition so as to completely fix color materials transferred onto printing paper. As the fixing index is smaller, the control unit 600 controls the fixing condition so as to increase an incomplete fixing layer of color materials transferred onto printing paper.

In this manner, the control unit 600 executes the exposure control based on the set toner reduction ratio and the fixing control based on the set fixing index, thereby forming an image having a fixing rate corresponding to the toner reduction ratio and fixing index.

This embodiment controls a fixing rate according to transmittance of printing paper by focusing attention on a case in which an image having a higher viewing density is obtained by leaving an incomplete fixing layer in place of complete fixing of a toner layer when transmitted light from the backside face exists. By controlling the fixing rate, both a high viewing density of a formed image, and a reduction of a toner consumption amount can be attained. That is, when the printing mode is "viewing-density priority", control is made to attain a maximum viewing density of a formed image; when the printing mode is "toner saving", a toner consumption amount can be reduced while suppressing a decrease in viewing density of a formed image.

Second Embodiment

The second embodiment according to the present invention will be described below. The aforementioned first embodiment has explained the example in which the mounted amount of toner is controlled by the exposure control. However, the control method of the mounted amount is not limited to this example. The second embodiment will explain a method of controlling the mounted amount of toner using a developing condition. Note that since the arrangement of an image processing apparatus according to the second embodiment is the same as that of the first embodiment, the same reference numerals denote the same components, and a detailed description thereof will not be repeated. Only parts especially different from the first embodiment will be described below.

Figure 13:
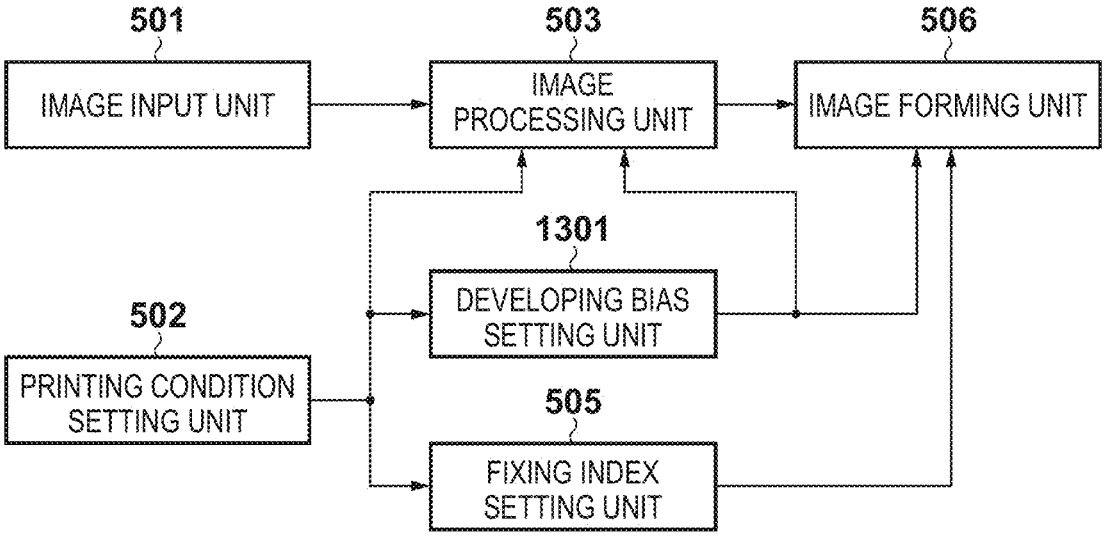
FIG. 13 is a block diagram showing the arrangement of an image processing apparatus according to the second embodiment.

FIG. 13 is a block diagram showing the arrangement of the image processing apparatus of the second embodiment. A developing bias setting unit 1301 of the second embodiment sets a toner reduction ratio based on FIGS. 10A and 10B, sets a developing bias as a developing condition based on the set toner reduction ratio, and outputs information indicating the set developing bias to a control unit 600 of an image forming unit 506. The control unit 600 controls a developing bias of a developer 606 based on the input information indicating the developing bias.

Figure 14:
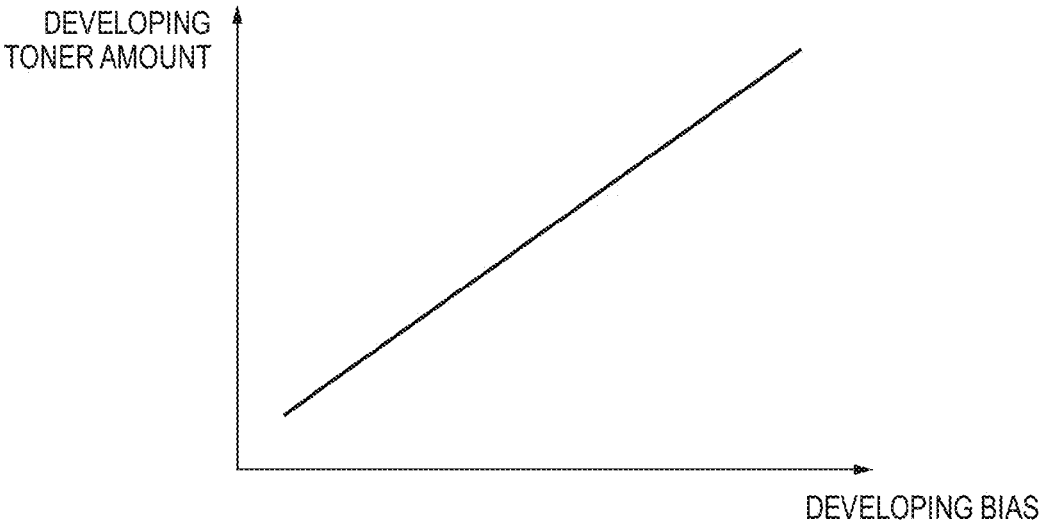
FIG. 14 is a graph showing the relationship between a developing bias and developing toner amount.

FIG. 14 shows the relationship between the developing bias and developing toner amount. According to a graph shown in FIG. 14, a developing bias required to develop a predetermined toner amount can be determined. That is, when the developing bias setting unit 1301 holds, in advance, a table indicating the relationship between the developing bias and developing toner amount shown in FIG. 14, the developing bias can be appropriately controlled in accordance with the toner reduction ratio. Thus, the developing bias setting unit 1301 can appropriately control the mounted amount of toner in correspondence with a target value (toner reduction ratio).

However, when the developing bias is changed, the relationship between image signal values input by an image input unit 501 and lightness values of an image formed on printing paper changes. For this reason, a gamma correction unit 804 changes a gamma correction table to be used in accordance with the set developing bias.

As described above, according to the second embodiment, an image signal processed by an image processing unit 503, a developing bias set by the developing bias setting unit 1301 based on a printing condition, and a fixing index set by a fixing index setting unit 505 are supplied to the image forming unit 506. The control unit 600 of the image forming unit 506 executes an image formation process by controlling operations of respective components of the image forming unit 506 based on the input developing bias and fixing index. As a result, an image according to the printing condition is formed on printing paper.

As described above, by controlling the mounted amount of toner based on the developing bias, which is set based on the toner reduction ratio, the fixing rate of toner is controlled in the same manner as in the first embodiment, thus attaining both a high viewing density of a formed image and a reduction of a toner consumption amount.

Modification of Embodiments

In the aforementioned first embodiment, the mounted amount of toner is controlled based on the toner reduction ratio by the exposure control. Also, in the second embodiment, the mounted amount of toner is controlled based on the toner reduction ratio by controlling the developing bias. However, the control method of the mounted amount of toner is not limited to these specific embodiments. For example, when the color separation unit 802 and gamma correction unit 804 selectively use tables corresponding to the toner reduction ratio, the mounted amount of toner may be controlled.

The aforementioned embodiments have explained the example in which the toner reduction ratio and fixing index are determined in accordance with information associated with transmittance of printing paper, a printing mode, and a use style of a printed product. However, the application range of the present invention is not limited to this example.

Since a printed product of the electrophotographic printer cannot normally ignore incident light from the backside face, it is not indispensable to set the use style. In this case, since cases of "flat placing" in which a printed product is viewed on an object such as a dark desk or table are assumed to be minor, toner reduction ratios and fixing indices corresponding to "holding" or "bookbinding" are preferably used.

Also, it is not indispensable to set the printing mode, and a toner reduction ratio required to suppress the mounted amount of toner may be set as a default. In this case as well, by appropriately controlling the fixing rate, as described using FIG. 11, a viewing density equivalent to that of the related art can be attained. Also, when a toner reduction ratio which does not suppress the mounted amount of toner is set as a default, a printed product having a higher viewing density than that of the related art can be obtained by appropriately controlling the fixing rate.

In the example of the above description, the present invention is applied to image formation in the electrophotographic printer. Also, the present invention is applicable to an image formation process in which color materials mounted to a printing medium are fixed to form a visible image on the printing medium like in an inkjet printing system or thermal transfer system using pigment inks.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-242215 filed Nov. 1, 2012 which is hereby incorporated by reference herein in its entirety.

What is claimed is:

1. An image processing apparatus comprising:

an acquisition unit configured to acquire transmission information indicating transmittance of light of a printing medium used in image formation;

a first setting unit configured to set a reduction ratio indicating maximum percentages of mounted amount of color materials with respect to a maximum amount of mounted color materials used in the image formation based on the transmission information;

a second setting unit configured to set a fixing index indicating a fixing state of the color materials with respect to the printing medium based on the transmission information; and a third setting unit configured to allow a user to set a printing condition, wherein the first setting unit and the second setting unit make the settings based on the transmission information and the printing condition, and wherein the printing condition comprises a viewing-density priority mode and a color material saving mode as printing modes, the reduction ratio in the color material saving mode is set to be less than the reduction ratio in the viewing-density priority mode, and the fixing index in the color material saving mode is set to be greater than the fixing index in the viewing-density priority mode.

2. The apparatus according to claim 1, wherein the printing condition comprises "holding", "flat placing", and "bookbinding" as use styles of a printed product, and a greater fixing index is set in an order of "holding", "bookbinding", and "flat placing".

3. An image processing apparatus comprising:

an acquisition unit configured to acquire transmission information indicating transmittance of light of a printing medium used in image formation;

a first setting unit configured to set a reduction ratio indicating maximum percentages of mounted amount of color materials with respect to a maximum amount of mounted color materials used in the image formation based on the transmission information;

a second setting unit configured to set a fixing index indicating a fixing state of the color materials with respect to the printing medium based on the transmission information; and an image forming unit configured to execute the image formation by controlling an exposure condition based on the reduction ratio, and controlling a fixing condition based on the fixing index, wherein the image forming unit comprises a photosensitive body on which an electrostatic latent image is formed, and a fixing unit which fixes the color materials transferred onto the printing medium, and wherein the exposure condition comprises an exposure amount of the photosensitive body, and the fixing condition comprises a temperature, a pressure, and a fixing time of the fixing unit.

4. The apparatus according to claim 3, wherein the image forming unit controls the exposure amount of the photosensitive body so as to obtain a latent image potential of the photosensitive body according to the reduction ratio.

5. The apparatus according to claim 3, wherein the image forming unit controls the temperature, the pressure, and the fixing time of the fixing unit so as to obtain a degree of melting and fixing of the color materials transferred onto the printing medium according to the fixing index.

6. The apparatus according to claim 3, wherein the image forming unit controls the temperature, the pressure, and the fixing time of the fixing unit so as to completely fix the color materials transferred onto the printing medium in a case where the fixing index assumes a maximum value, and controls the temperature, the pressure, and the fixing time of the fixing unit so as to increase an incomplete fixing layer of the color materials transferred onto the printing medium as the fixing index decreases.

7. An image processing apparatus comprising:

an acquisition unit configured to acquire transmission information indicating transmittance of light of a printing medium used in image formation;

a first setting unit configured to set a reduction ratio indicating maximum percentages of mounted amount of color materials with respect to a maximum amount of mounted color materials used in the image formation based on the transmission information;

a second setting unit configured to set a fixing index indicating a fixing state of the color materials with respect to the printing medium based on the transmission information;

a correction unit configured to apply gamma correction to image data as a target of the image formation using a gamma correction table, so that the mounted amount of the color materials in the image formation satisfies the maximum amount of mounted color materials; and an image forming unit configured to execute the image formation by controlling development of an electrostatic latent image based on a developing condition, and controlling a fixing condition based on the fixing index, wherein the first setting unit sets the developing condition based on the reduction ratio, wherein the correction unit uses a gamma correction table corresponding to the developing condition, wherein the image forming unit comprises a developer which develops the electrostatic latent image using the color materials, and a fixing unit which fixes the color materials transferred onto the printing medium, and wherein the developing condition comprises a developing bias of the developer, and the fixing condition comprises a temperature, a pressure, and a fixing time of the fixing unit.

8. The apparatus according to claim 7, wherein the image forming unit controls the temperature, the pressure, and the fixing time of the fixing unit so as to obtain a degree of melting and fixing of the color materials transferred onto the printing medium according to the fixing index.

9. The apparatus according to claim 7, wherein the image forming unit controls the temperature, the pressure, and the fixing time of the fixing unit so as to completely fix the color materials transferred onto the printing medium in a case where the fixing index assumes a maximum value, and controls the temperature, the pressure, and the fixing time of the fixing unit so as to increase an incomplete fixing layer of the color materials transferred onto the printing medium as the fixing index decreases.

10. An image processing method comprising:

using a processor to perform steps of:

acquiring transmission information indicating transmittance of light of a printing medium used in image formation;

setting a reduction ratio indicating maximum percentages of mounted amount of color materials with respect to a maximum amount of mounted color materials used in the image formation based on the transmission information;

setting a fixing index indicating a fixing state of the color materials with respect to the printing medium based on the transmission information; and allowing a user to set a printing condition, wherein, in the first and second setting steps, the settings are made based on the transmission information and the printing condition, and wherein the printing condition comprises a viewing-density priority mode and a color material saving mode as printing modes, the reduction ratio in the color material saving mode is set to be less than the reduction ratio in the viewing-density priority mode, and the fixing index in the color material saving mode is set to be greater than the fixing index in the viewing-density priority mode.

11. A non-transitory, computer-readable medium storing a computer-executable program for causing a computer to perform an image processing method, the method comprising steps of:

acquiring transmission information indicating transmittance of light of a printing medium used in image formation;

setting a reduction ratio indicating maximum percentages of mounted amount of color materials with respect to a maximum amount of mounted color materials used in the image formation based on the transmission information;

setting a fixing index indicating a fixing state of the color materials with respect to the printing medium based on the transmission information; and allowing a user to set a printing condition, wherein, in the first and second setting steps, the settings are made based on the transmission information and the printing condition, and wherein the printing condition comprises a viewing-density priority mode and a color material saving mode as printing modes, the reduction ratio in the color material saving mode is set to be less than the reduction ratio in the viewing-density priority mode, and the fixing index in the color material saving mode is set to be greater than the fixing index in the viewing-density priority mode.

* * * * *